United States Patent [19]

Nelson

[11] Patent Number: 4,682,475

[45] Date of Patent: Jul. 28, 1987

[54] ICE MAKING APPARATUS

[75] Inventor: Kenneth L. Nelson, Albert Lea, Minn.

[73] Assignee: King-Seeley Thermos Co., Prospect Heights, Ill.

[21] Appl. No.: 837,411

[22] Filed: Mar. 7, 1986

Related U.S. Application Data

[60] Division of Ser. No. 694,612, Jan. 24, 1985, Pat. No. 4,574,593, which is a continuation-in-part of Ser. No. 570,610, Jan. 13, 1984, Pat. No. 4,576,016.

[51] Int. Cl.[4] ..... F25C 1/14

[52] U.S. Cl. ..... 62/354; 366/310; 366/322; 425/208

[58] Field of Search ..... 62/354; 165/94; 366/90, 366/310, 322; 425/208

[56] References Cited

U.S. PATENT DOCUMENTS

| | | | |
|---|---|---|---|
| 505,975 | 10/1893 | Fate | 366/322 X |
| 1,424,445 | 8/1922 | Bowen et al. | 366/90 X |
| 2,576,995 | 12/1951 | Carvel | 366/310 |
| 3,570,654 | 3/1971 | Hill | 366/322 x |
| 3,601,370 | 8/1971 | Ruettener | 366/322 X |
| 3,643,454 | 2/1972 | Turner | 62/354 X |
| 4,045,401 | 8/1977 | Stenmark et al. | 366/90 X |
| 4,103,355 | 7/1978 | Weber | 366/322 X |
| 4,193,696 | 3/1980 | Van Heel et al. | 366/322 X |

FOREIGN PATENT DOCUMENTS

| | | | |
|---|---|---|---|
| 1142059 | 1/1963 | Fed. Rep. of Germany | 366/90 |
| 1298700 | 7/1969 | Fed. Rep. of Germany | 366/90 |
| 57-108570 | of 1982 | Japan . | |
| 58-49171 | of 1983 | Japan . | |
| 58-85166 | of 1983 | Japan . | |

*Primary Examiner*—William E. Tapolcai

*Attorney, Agent, or Firm*—Harness, Dickey & Pierce

[57] ABSTRACT

A new and improved auger-type ice-making apparatus preferably includes at least a pair of removable and interchangeable head assemblies adapted for preselectively producing either relatively dry flake or chip ice, cube ice or smaller nugget-sized ice pieces. A new and improved auger assembly preferably formed from a synthetic plastic material and a new and improved evaporator element are also disclosed, either or both of which can be incorporated into an ice-making apparatus, with or without the interchangeable head assemblies. One preferred embodiment is adapted to preselectively alter the size of the cube or nugget ice pieces in order to preselectively produce a number of different sizes of ice pieces.

31 Claims, 26 Drawing Figures

FIG. 3.
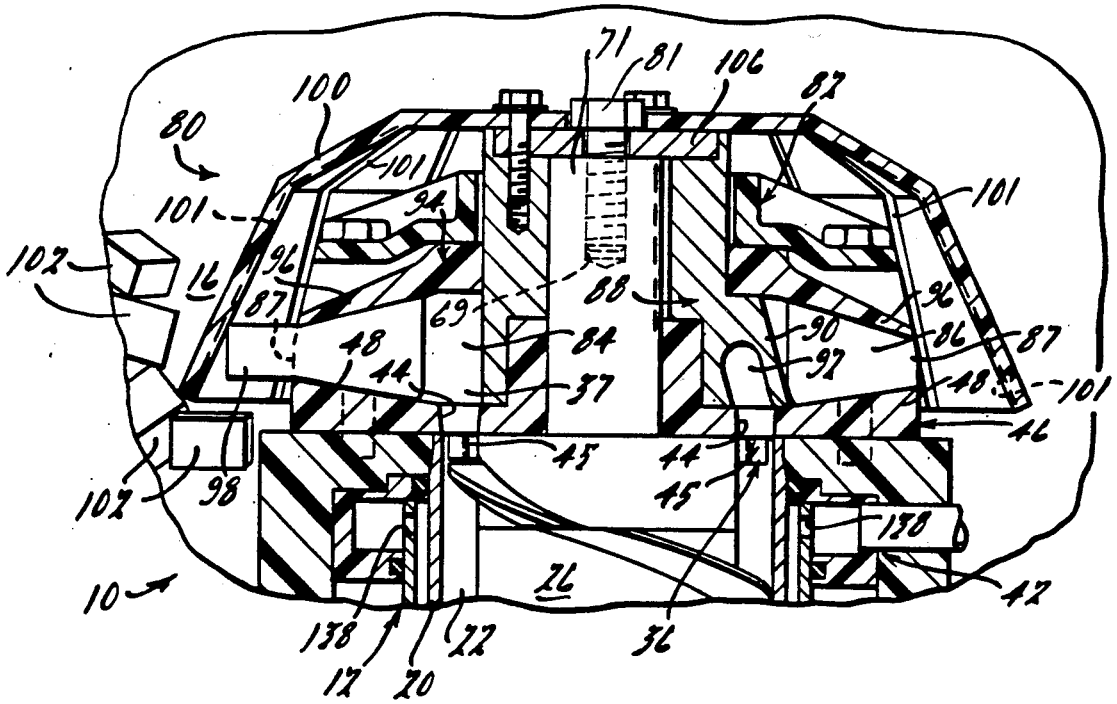
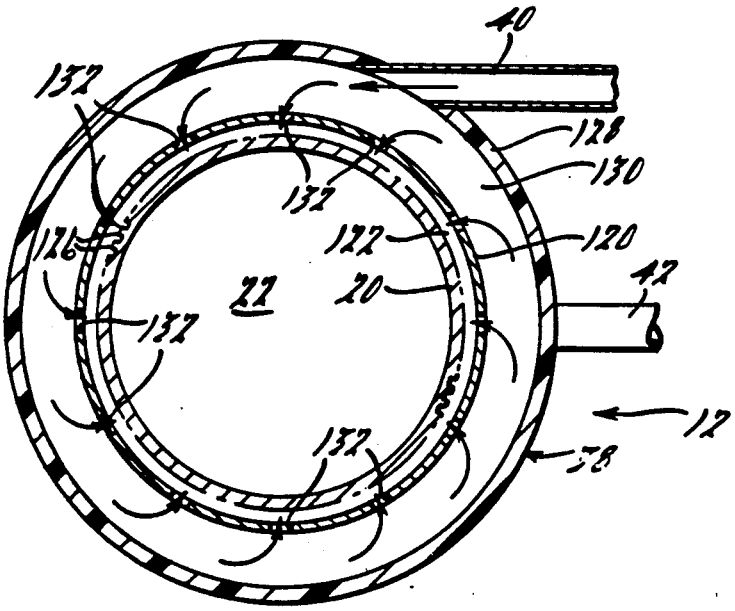
FIG. 5.
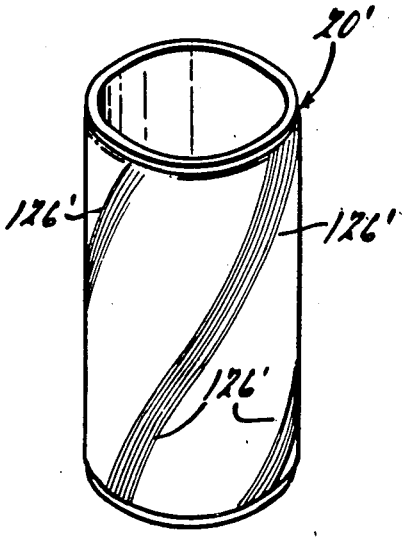
FIG. 9.

ICE MAKING APPARATUS

BACKGROUND AND SUMMARY OF THE INVENTION

This is a division of U.S. patent application Ser. No. 694,612, filed Jan. 24, 1985, now U.S. Pat. No. 4,574,593, which is a continuation-in-part of U.S. patent application Ser. No. 570,610, filed Jan. 13, 1984, now U.S. Pat. No. 4,576,016, the disclosure of which is incorporated herein by reference.

Generally, the present invention is directed toward a new and improved ice-making apparatus of the type including a combination evaporator and ice-forming assembly having a substantially cylindrical freezing chamber with an auger rotatably mounted therein for scraping ice particles from the inner surface of the freezing chamber in order to form quantities of relatively wet and loosely associated ice particles. More specifically, the present invention is directed toward such an ice-making apparatus that preferably includes interchangeable head assemblies removably connectable to the combination evaporator and ice-forming assembly and adapted to produce different types of ice products, including relatively dry loosely associated flake or chip ice particles or discrete compacted ice pieces of various preselected sizes merely by preselectively connecting the appropriate head assembly to the combination evaporator and ice-forming assembly and performing simple adjustments. Additionally, the present invention is directed toward an ice-making apparatus which incorporates new and improved components, assemblies, and subassemblies, including a new combination evaporator and ice-forming assembly, a new auger member, and new ice breaking components, as well as other novel and inventive features.

Various ice-making machines and apparatus have been provided for producing so-called flake or chip ice and have frequently included vertically-extending rotatable augers that scrape ice crystals or particles from tubular freezing cylinders disposed about the periphery of the augers. The augers in some of such prior devices typically urge the scraped ice in the form of a relatively wet and loosely associated slush through open ends of their freezing cylinders, and perhaps through a die or other device in order to form the flake or chip ice product. Still other prior ice-making machines or apparatuses have included devices for forming the discharged slush into relatively hard ice in order to form discrete ice pieces of various sizes, including relatively large ice pieces commonly referred to as "cubes" and relatively small ice pieces commonly referred to as "nuggets". Such nugget ice pieces may have either a regular shape or an irregular shape, and are larger than flake or chip ice pieces, but are smaller than cube ice pieces. Nugget ice pieces are also sometimes referred to as "small cubelets". Still other ice-making devices have included mold-type structures onto which unfrozen water is sprayed or otherwise collected, frozen, and then released in order to form and dispense such ice cubes or ice nuggets.

Typically the ice-making machines or apparatuses of the type described above have been exclusively adapted or dedicated to the production of only one type and/or size of ice product, namely flake or chip ice, cube ice, or nugget ice. Therefore, if it was desired to have the capability of producing a variety of types and/or sizes of ice in a given installation, as many as three or more separate ice-forming machines or apparatuses were required. Such a situation has been found to be highly undesirable due to the relatively high cost of purchasing, installing and maintaining such separate ice-forming machines or apparatuses, and due to the relatively large amount of space required for such multiple installations. The need has thus arisen for a single ice-making machine or apparatus that is capable of being conveniently and easily adaptable to produce various types, sizes, or forms, of ice products, including flake or chip ice, cube ice, or nugget ice.

Furthermore, in the ice-making machines or apparatuses of the above-described type having a rotatable auger, such augers have frequently been machined out of a solid piece of stainless steel or other such material and thus have been found to be inordinately expensive and complex to manufacture, as well as being relatively heavy in weight and requiring a relatively powerful drive means that is expensive to purchase, maintain, and operate. Accordingly, the need has also arisen for an auger device that is less expensive and complex to produce and less expensive to operate.

Finally, in ice-making machines or apparatuses of the above-described types, the evaporator portions of the combination evaporator and ice-forming assemblies have frequently been found to be relatively large in size, relatively inefficient in terms of energy consumption, and relatively expensive to produce. Thus, the need has also arisen for an evaporator means having increased thermal efficiency, and therefore being smaller in size, and which is less expensive to manufacture.

An ice-making machine or apparatus according to the present invention includes a refrigeration system and a combination evaporator and ice-forming assembly preferably comprising at least a pair of interchangeable head assemblies removably connectable to the combination evaporator and ice-forming assembly, each of said interchangeable head assemblies being adapted to produce different types and/or sizes of ice products, namely flake or chip ice, cube ice and/or nugget ice, for example. In the preferred form of the invention, such head assemblies are removably interchangeable and connectable to the combination evaporator and ice-forming assembly without replacing or altering the outlet portion of the combination assembly, and are adapted to form their respective types and/or sizes of ice product from the relatively wet and loosely associated slush ice particles discharged from the combination evaporator and ice-forming assembly. Preferably, at least one head assembly is adapted for producing flake or chip ice and includes means for conveniently and easily preselectively altering the amount of unfrozen water that is removed from the relatively wet and loosely associated slush discharged from the combination evaporator and ice-forming assembly. Also preferably, one of the interchangeable head assemblies is conveniently and easily preselectively adaptable to produce discrete relatively hard ice products of either the cube or the nugget type, or various other preselected sizes. Preferably, this interchangeable head assembly includes a preselectively adjustable ice breaking apparatus for quickly and conveniently altering the size of the discrete ice products.

An ice-making machine or apparatus according to the present invention, whether or not including the above-discussed interchangeable head assemblies or other components, also preferably includes an auger member or assembly having one or more generally spiral flight portions thereon, with spirally misaligned, discontinuous, and/or circumferentially-spaced segments of the flight portion that serve to break up the relatively wet and loosely associated slush ice quantities produced in the combination evaporator and ice-forming assembly. In one form of the invention, the auger member or assembly is preferably composed of a series of discrete disc elements or segments axially stacked on a rotatable shaft and secured for rotation therewith. Such discrete disc elements can be individually molded from inexpensive and lightweight synthetic plastic materials. In another form of the invention, the auger member or assembly includes a rotatable core onto which the auger body is integrally molded from a synthetic plastic material. In such embodiment of the invention, the spiral flight portion can be molded along with the remainder of the body of the auger or can be a discrete structure integrally molded therein.

An ice-making machine or apparatus according to the present invention, whether or not including the other invention features or components described above, preferably includes a combination evaporator and ice-forming assembly having an inner housing defining a substantially cylindrical freezer chamber, an outer jacket spaced therefrom to form a generally annular refrigerant chamber therebetween, and generally annular inlet and outlet refrigerant manifolds at opposite ends thereof. In at least one preferred embodiment, the inlet and/or outlet manifolds include a distributor member that acts to relatively uniformly distribute the refrigerant flow around and throughout the annular refrigerant chamber, and to induce a desired turbulence to the refrigerant flow, in order to obtain a relatively uniform cooling effect. The refrigerant chamber can optionally include a plurality of discontinuities or fin-like members therein which further enhance the turbulent flow of the refrigerant material and substantially increase the effective heat transfer surface of the inner housing. The combination evaporator and ice-forming assemblies can optionally be adapted to be axially stacked onto one another in order to form a combination evaporator and ice-forming assembly having a preselectively variable capacity to suit a given application.

It is accordingly a general object of the present invention to provide a new and improved ice-making machine, apparatus or system.

Another object of the present invention is to provide a new and improved ice-making machine, apparatus or system having the capability of being conveniently and easily adapted to form a variety of types and/or sizes of ice products, such ice products including flake or chip ice, cube ice, and/or nugget ice.

A further object of the present invention is to provide a new and improved ice-making machine or apparatus that is more dependable in operation, inexpensive to manufacture and maintain, and that requires less space in order to produce a variety of ice products in a single installation.

Still another object of the present invention is to provide a new and improved ice-making macine, apparatus or system having reduced energy requirements by way of a new construction of the combination evaporator and ice-forming assembly, wherein portions and component parts and subassemblies are more efficient and/or are formed by molding a polymeric synthetic material such as plastic, and which possesses increased versatility and interchangeability of various components thereof.

Additional objects, advantages and features of the present invention will become apparent from the following description and the appended claims, taken in conjunction with the accompanying drawings.

BRIEF DESCRIPTION OF THE DRAWINGS

FIG.3 is a partial cross-sectional view, similar to that of FIG. 1, illustrating a second interchangeable head assembly for the combination evaporator and ice-forming assembly shown in FIG. 1.

FIG. 5 is a lateral cross-sectional view of the evaporator and freezing chamber portion of the combination evaporator and ice-forming assembly shown in FIG. 1, taken generally along line 5—5 thereof.

FIG. 9 is a perspective detail view of an alternate inner housing member for the combination evaporator and ice-forming assembly shown in FIGS. 1, 3 and 5 through 8.

FIG. 32 is a lateral cross-sectional viw of the evaporator and freezing chamber portion of the combination evaporator and ice-forming assembly shown in FIG. 13, taken generally along line 23—23 thereof.

DETAILED DESCRIPTION OF THE PREFERRED EMBODIMENTS

FIGS. 1 through 23 depict exemplary preferred embodiments of the present invention for purposes of illustration. One skilled in the art will readily recognize that the principles of the present invention are equally applicable to other types of ice-making apparatus as well as to other types of refrigeration in general.

Figure 1:
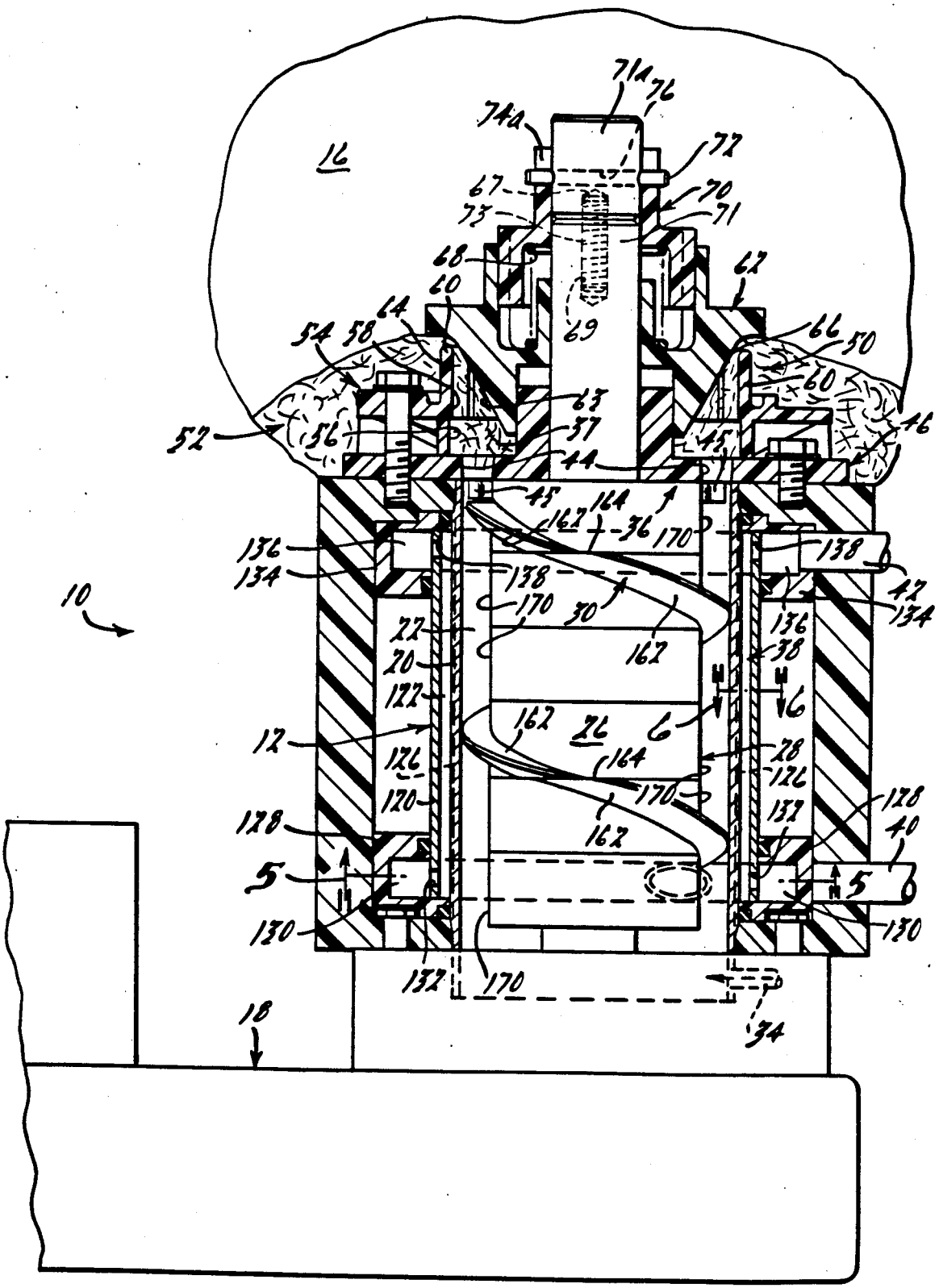
FIG. 1 is a partial cross-sectional view of a combination evaporator and ice-forming assembly of an ice-forming apparatus according to the present invention.

As shown in FIG. 1, an ice-making machine or apparatus 10, in accordance with one preferred embodiment of the present invention, generally includes a combination evaporator and ice-forming assembly 12 operatively disposed between an ice product receiving area 16 and a suitable drive means assembly 18. As is conventional in the art, the ice-making apparatus 10 is provided with a suitable refrigeration compressor and condensor (not shown), which cooperate with the combination evaporator and ice-forming assembly 12, all of which are connected through conventional refrigeration supply and return lines (not shown) and function in the usual manner such that a flowable gaseous refrigerant material at a relatively high pressure is supplied by the compressor to the condensor. The gaseous refrigerant is cooled and liquified as it passes through the condensor and flows to the evaporator and ice-forming assembly 12 wherein the refrigerant is evaporated or vaporized by the transfer of heat from water which is being formed into ice. The evaporated gaseous refrigerant then flows from the evaporator and ice-forming assembly 12 back to the inlet or suction side of the compressor for recycling through the refrigeration system.

Generally speaking, the combination evaporator and ice-forming assembly 12 includes an inner housing 20 defining a substantially cylindrical freezing chamber 22 for receiving ice make-up water therein. An axially-extending auger or auger assembly 26 is rotatably disposed within the freezing chamber 22 and generally includes a central body portion 28 with a generally spirally-extending flight portion 30 thereon disposed in the space between the central body portion 28 and the inner surface of the inner housing 20 in order to rotatably scrape ice particles from the cylindrical freezing chamber 22. The drive means assembly 18 rotatably drives the auger 26 such that when unfrozen ice make-up is introduced into the freezing chamber 22 through a suitable water inlet means 34 and frozen therein, the rotating auger 26 forcibly urges quantities of relatively wet and loosely associated slush ice particles 37 through the freezing chamber 22 to be discharged through an ice outlet end 36 of the combination evaporator and ice-forming assembly 12.

The relatively wet and loosely associated slush ice particles 37 are formed on the inner surface of the inner housing 20 in the usual manner by way of heat transfer between the freezing chamber 22 and an adjacent evaporator means 38, through the above-mentioned refrigerant material flows from the refrigerant inlet 40 to the refrigerant outlet 42. The refrigerant inlet and outlet 40 and 42, respectively, are connected to respective refrigerant supply and return lines of the above-mentioned conventional refrigeration system. The details of the auger assembly 26 and the evaporator means 38, as they relate to the present invention, will be more fully described below.

In FIG. 1, a first interchangeable head assembly 50 is shown removably connected to the outlet end 36 of the combination evaporator and ice-forming assembly 12 and is adapted for forming a relatively dry and loosely associated flake-type or chip-type ice product 52. As is described more fully below, the first head assembly 50 is removably connectable to the combination evaporator and ice-forming assembly 12, as by threaded fasteners, for example, extending through a divider plate 46, which defines and is preferably part of the ice outlet end 36 of the combination evaporator and ice-forming assembly 12 and thus remains thereon. The first head assembly 50 is interchangeable with at least one other head assembly (described below), which is also similarly removably connectable through the preferred divider plate 46 to the combination evaporator and ice-forming assembly 12.

Figure 2:
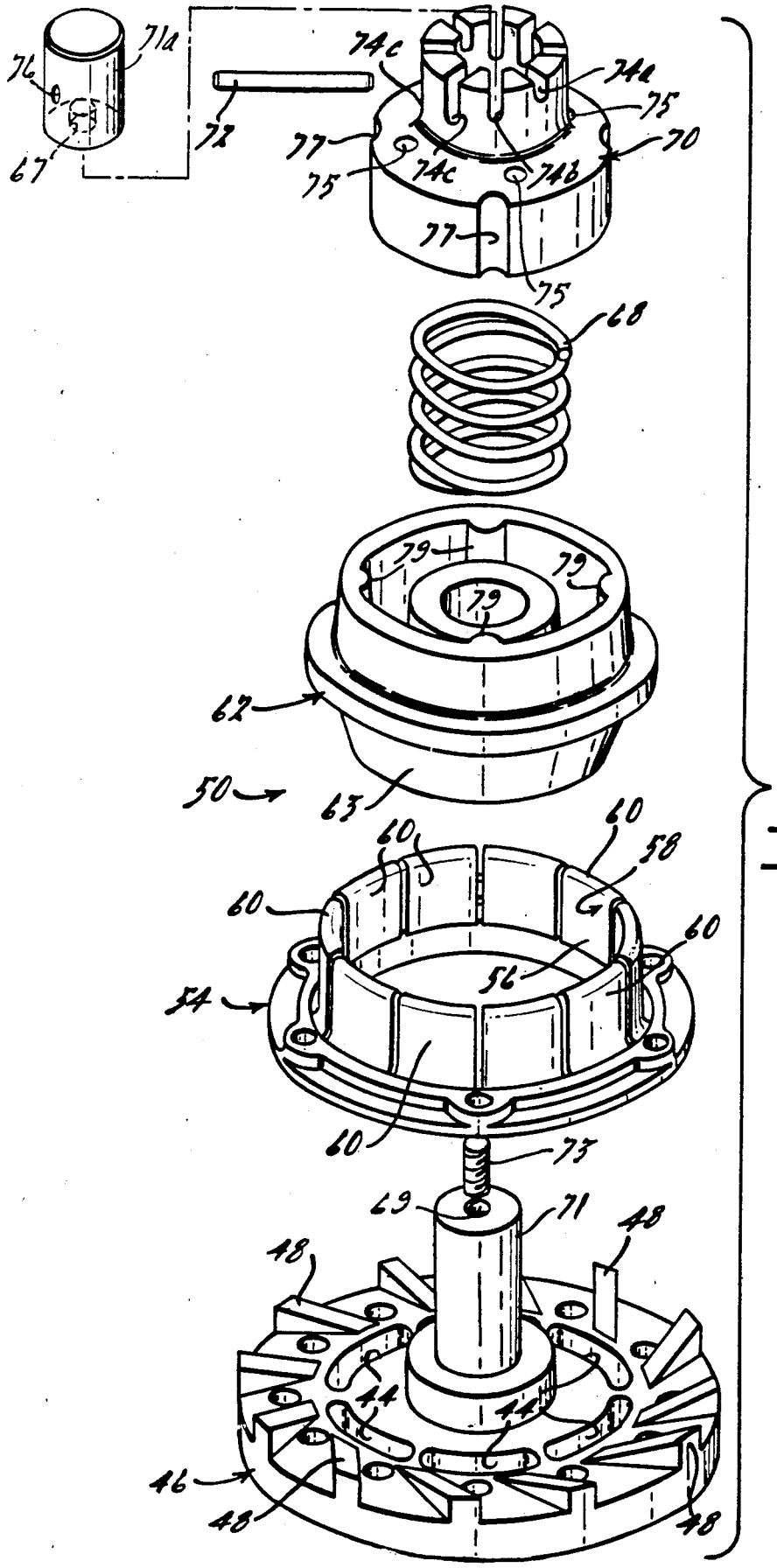
FIG. 2 is an exploded perspective view of the major components of a first interchangable head assembly of the combination evaporator and ice-forming assembly shown in FIG. 1.

The preferred form of the first interchangeable head assembly 50, shown in FIGS. 1 and 2, generally includes an annular collar member 54, removably connectable to the divider plate 46 preferably by way of threaded fasteners extending therethrough, and an inlet opening 56 in communication with one or more discharge openings 44 extending through the divider plate 46. The annular collar member 54 also includes an outer annular sleeve portion 58, which generally surrounds the inlet opening 56 and is preferably defined by a plurality of resilient and yieldable finger members 60 secured to, or integrally formed with, the remainder of the annular collar member 54. It should also be noted that the divider plate 46 can be equipped with protuberances 45 between adjacent openings 44 or other means for preventing or limiting rotation of the ice particles 37 as they exit the outlet end 36 of the combination evaporator and ice-forming assembly 12 and for centering the divider plate relative to the evaporator and ice-forming assembly 12.

An inner member 62 preferably includes a generally sloped or arcuate portion 63 extending at least partially into the interior of the outer annular sleeve portion 58 in a direction toward the inlet opening 56. The inner member 62 and the outer annular sleeve portion 58 of the collar member 54 are spaced from one another to define therebetween an annular compression passage 64, which terminates in an outlet annulus 66. Because of the sloped or arcuate configuration of the inner member portion 63, the annular compression passage 64 preferably has a decreasing annular cross-sectional area from the inlet opening 56 to the outlet annulus 66 in order to compress the wet and loosely associated slush ice particles 37 that are forcibly urged therethrough from the combination evaporator and ice-forming assembly 12.

In addition to such decreasing annular cross-sectional area, the resilent finger members 60 establish a resilient resistance to outward movement of the wet and loosely associated ice particles 37 in order to further compress such particles 37 and remove at least a portion of the unfrozen water therefrom so as to form relatively dry and loosely associated flake or chip particles 52. The resilient fingers 60 also provide for a "fail-safe" feature in that they are resiliently yieldable at least in a radially outward direction in order to allow the ice particles 37 to continue to be discharged from the outlet annulus 66 even in the event of a failure of the spring member 68 such that the size and shape of the compression passage 64 is altered. Such fail-safe feature thus permits a continued, albeit somewhat strained, operation of the ice-making apparatus even in the event of such a spring failure.

In addition to the above-discussed compressive forces exerted on the wet and loosely associated slush ice particles 37, the inner member 62 is also resiliently directed or forced toward the inlet opening 56 by a spring member 68 disposed in compression between the inner member 62 and a retainer member 70 axially fixed to the shaft member extension 71a, which is in turn secured to the shaft member 71 of the auger assembly 26. The shaft member extension 71a is preferably secured to the shaft member 71 by a threaded stud 73 threadably engaging the threaded holes 67 and 69 and thus interconnecting the shaft member and extension 71 and 71*a*, respectively. Such spring member 68, as well as the resilient fingers 60, serve to reduce the torque required to drive the auger assembly 26 and thereby lower the energy consumption of the ice-making apparatus. In the preferred form of the present invention, the retainer member 70 is axially fixed to the shaft member 71 and the shaft member extension 71*a* by a pin member 72 extending through one of a number of slots 74*a*, 74*b*, 74*c*, or 74*d* (shown in FIG. 2) in the retainer member 70 and through an aperture 76 in the shaft member extension 71*a*. By urging the retainer member 70 toward the inlet opening 56 to compress the spring member 68 enough so that the retainer member 70 is clear of the pin member 72, the retainer member 70 can be rotated and then released so that the pin member 72 lockingly engages any one of the slots 74*a*, 74*b*, 74*c* or 74*d* (see FIG. 2). Because the axial depth of the slots 74*a*, 74*b*, 74*c* and 74*d* varies from slot-to-slot, the magnitude of the resilient force exerted on the inner member 62 by the spring member 68 may be preselectively altered merely by changing slots, thereby preselectively altering the amount of unfrozen water compressively removed from the relatively wet and loosely associated ice particles 37 being compressed in the annular compression passage 64. Thus, the relative dryness of the loosely associated flake or chip ice product 52 being discharged from the first interchangeable head assembly 50 may be preselectively altered to suit the desired quality of flake or chip ice products being produced in a given application.

It should be noted that in order to facilitate the ease of rotation of the retainer member 70 while the spring member 68 is compressed in order to change slots as described above, the retainer member 70 is preferably provided with radial indentations 77 that receive and engage radial protrusions 79 on the inner member 62. The indentations 77 and the protrusions 79 are both axially elongated to allow the retainer member 70 to slide axially relative to the inner member 62, while being rotationally interlocked therewith. Thus since the inner member 62 is not directly fixed to the shaft member 71 or its extension 71*a*, it rotates with both the retainer member 70 and the spring member 68 during the slot changing, thus avoiding the need to overcome the frictional engagement of the compressed spring member 68 with the retainer member 70 or the inner member 62 during rotation of the retainer member 70. Furthermore, during operation of the ice-making apparatus, the interlocking relationship of the retainer member 70 and the inner member 62 also causes the inner member 62 to be rotated with the shaft member 71 and its extension 71*a* by way of the retainer member 70. Such rotation causes the inner member 62 to polish or "trowel" the ice particles as they pass through the compression passage 64 in order to enhance the clarity, hardness and uniformity of size of the chip ice product 52 discharged from the first head assembly 50.

It should be noted that any of a number of known means for preselectively fixing the retainer member 70 to various axial locations of the shaft member 71 or its extension 71*a* may be employed, and also that in the embodiment shown in FIGS. 1 and 2, virtually any number of slots may be formed in the retainer member 70. It should further be noted that in lieu of the arrangement shown in FIGS. 1 and 2, the retainer member 70 can alternatively be provided with only a single slot or aperture for receiving the pin member 72, and the shaft member 71 (or its extension 71*a*) can be provided with a number of apertures extending therethrough at various axial positions. In this alternate arrangement the compression and resilient force of the spring member 68 can be preselectively altered by inserting the pin member 72 through the single aperture in the retainer member 70 and through a preselected one of the multiple apertures in the shaft member 71 (or its extension 71*a*).

Figure 4:
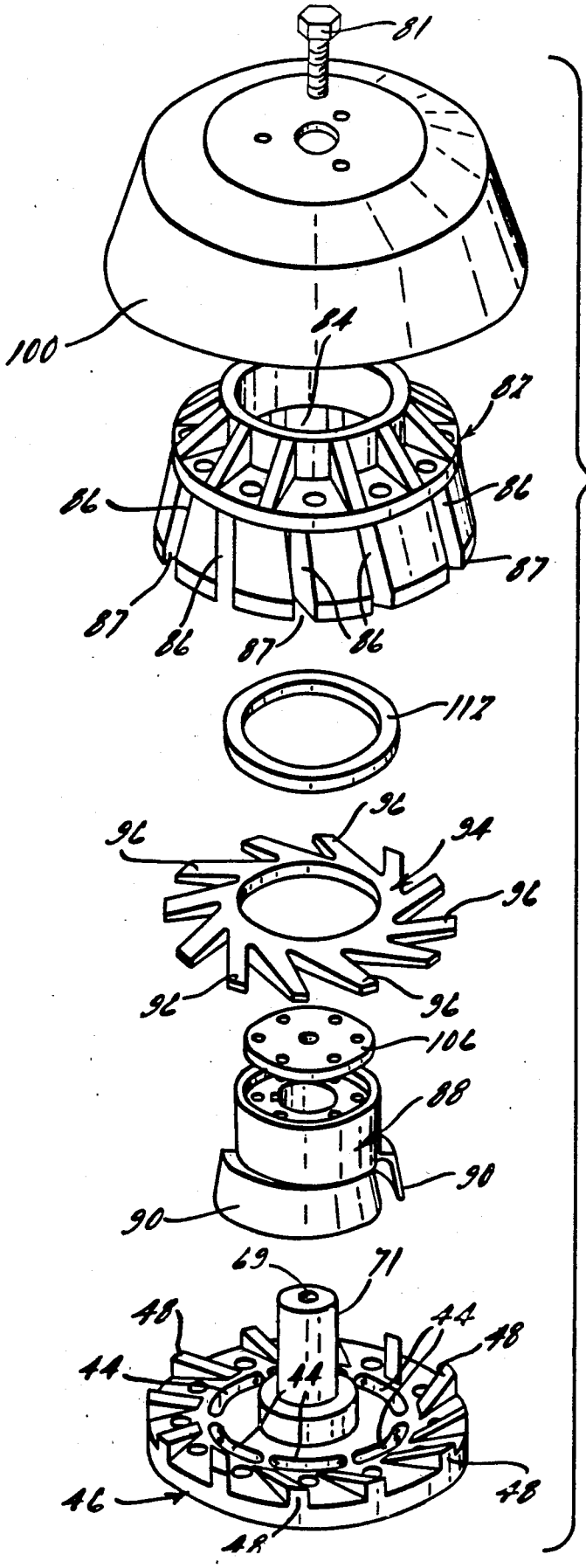
FIG. 4 is an exploded perspective view of the major components of the second interchangeable head assembly shown in FIG. 3.

As illustrated in FIGS. 3 and 4, the first interchangeable head assembly 50 shown in FIGS. 1 and 2 can be disconnected and separated from above the divider plate 46 of the combination evaporator and ice-forming assembly 12, and a second interchangeable head assembly 80 can be removably connected thereto in order to produce discrete relatively hard compacted ice pieces of the cube or nugget type. The second interchangeable head assembly 80 generally includes a compacting member 82 removably connected to the combination evaporator and ice-forming assembly 12, through the divider plate 46, and has a generally hollow internal chamber 84 therein, which communicates with one or more discharge openings 44 in the divider plate 46. The compacting member 82 also includes a plurality of compacting passages 86 in communication with the hollow internal chamber 84 and extending generally outwardly therefrom.

Preferably, an insert 94 is disposed within the hollow internal chamber 84 of the compacting member 82 and includes a plurality of resilient fingers 96 extending outwardly into the compacting passages 86. Because the resilient fingers 96 extend outwardly and slope generally toward the divider plate 46, and because the vanes 48 on the divider plate 46 slope generally toward the compacting member 82, the cross-sectional area of each of the compacting passages 86 decreases from the hollow internal chamber 84 to their respective outer openings 87.

A cam member 88, which is preferably composed of stainless steel, brass, or any of a numer of synthetic plastic materials suitable for operation at or below 32 F, is rotatably disposed within the hollow internal chamber 84 and is keyed or otherwise secured for rotation with the shaft member 71 after the preferred shaft member extension 71*a* has been removed. The cam member 88 includes one or more cam lobes 90 that forcibly engage and urge the relatively wet and loosely associated slush ice particles 37 through the compacting passages 86 as the cam member 88 is rotated in order to forcibly compress and compact the slush ice particles 37 into a relatively hard, substantially continuous, elongated compacted ice form 98. An ice breaker 100, preferably having a number of internal ribs 101 thereon, is also secured to the shaft member 71 for rotation therewith and breaks the elongated compacted ice form 98 into discrete compacted ice cubes 102 as the shaft member 71 rotates. It should be noted that the cam member 88 preferably also includes an inlet passage 92 through one or all of the cam lobes 90 for allowing the slush ice particles 37 to enter the hollow internal chamber 84 even when one of the cam lobes 90 passes over one of discharge openings 44 in the divider plate 46.

The ice cubes 102 have the same lateral cross-sectional shape and size as the elongated compacted form 98 discharged from the compacting passages 86, and the length of the ice cubes 102 is determined by the position of the ice breaker 100 relative to the outer openings 87 of the compacting passages 86. Thus, in order to preselectively alter the length and therefore the size, of the ice cubes 102, a number of different cam top disc members 106 having different axial thicknesses may be interchangeably inserted between the ice breaker 100 and the upper portion of the cam member 88 in order to preselectively alter the position of the ice breaker 100 relative to the outer openings 87 of the compacting passages 86. It should be noted that as an alternate to providing a number of cam top disc members 106 having different axial thicknesses, a preselected number of alternate cam top disc members having the same axial thicknesses may be axially stacked onto one another between the ice breaker 100 and the upper portion of the cam member 88 in order to preselectively alter the spacing between the ice breaker 100 and the outlet openings 87 of the compacting passages 86. As discussed below, and as shown in FIGS. 13 through 18, other alternate means are provided for preselectively altering the size of the ice cubes 102, without the necessity of changing cam top disc members.

In order to preselectively adapt the second interchangeable head assembly 80 for producing relatively hard compacted ice pieces of the nugget size or other size smaller than the ice cubes 102, an optional spacer ring 112 (shown in FIG. 4) may be inserted in the hollow internal chamber 84 between the compacting member 82 and the insert 94. The preselective insertion of one or more of the spacer rings 112 alters the position of the resilient fingers 96 in the compacting passages 86 and thereby reduces the lateral cross-sectional size of the outlet openings 87. In conjunction with the insertion of the spacer ring 112 into the hollow internal chamber 84, the position of the ice breaker 100 may also be preselectively altered as described above in order to preselectively alter the length of the smaller discrete ice pieces formed by the second interchangeable head assembly 80. In this regard, it should be noted that a different cam member, generally similar to cam member 88 but having a shorter axial height, may be required to be substituted in place of the cam member 88, in order to produce very small nugget-size discrete ice pieces. Such shorter axial height of the substitute cam member may be required in order to allow the ice breaker 100 to be positioned sufficiently closer to the outer openings 87 to break off the elongated ice form 98 into nugget-size compacted ice pieces and also to provide vertical space for the addition of the spacer ring 112. Such an axially shorter cam member may not be necessary if the alternate (and now preferred) ice breaker means of FIGS. 13 through 18 is used.

It should be noted, with reference to FIG. 2, that apertures 75 can be provided in the retainer member 70 so that the ice breaker 100 can optionally be attached to the retainer member in the first interchangeable head assembly 50. In such an application, the ice breaker 100 can be used to urge the flake or chip-type ice product 52 (see FIG. 1) into the proper desired dispensing portion of the ice-making apparatus 10.

It should also be noted that the various components of the first and second interchangeable head assemblies described herein, including the cam members in the various embodiments of the second interchangeable head assemblies, can be molded from synthetic plastic materials in order to decrease their cost and weight. The plastic materials should, however, be capable of withstanding the forces, low temperatures, and other parameters encountered by such components in an ice-making apparatus, such parameters being readily determinable by those skilled in the art. One preferred example of such a plastic material is Delrin brand acetal thermoplastic resin, which is available in a variety of colors for purposes of color-coding various components in order to facilitate ease of proper assembly and identification of parts. "Delrin" is a trademark of E. I. duPont DeNemours & Co. Other suitable materials, such as appropriate metals for example, can also alternatively be employed.

Figure 6:
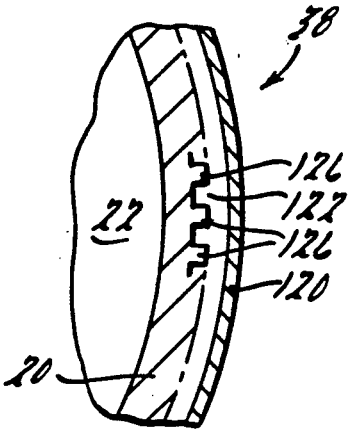
FIG. 6 is an enlarged cross-sectional view taken along 6—6 of FIG. 1.

As shown in FIGS. 1, 5 and 6, the combination evaporator and ice-forming assembly 12 features a new and improved evaporator means 38, which preferably includes the tubular inner housing 20 defining a substantially cylindrical freezing chamber 22 therein, an outer jacket member 120 generally surrounding, and radially-spaced from, the inner housing 20, in order to define a generally annular refrigerant chamber 122 therebetween. The generally annular refrigerant chamber 122, which is sealingly closed at both axial ends, contains the flowable refrigerant material being evaporated, as described above, in response to the heat transfer from the water being frozen into the wet and loosely associated slush ice particles 37 in the freezing chamber 22. In order to enhance the turbulent flow of the refrigerant material through the annular refrigerant chamber 122, and to substantially maximize the heat transfer surface area of the outer surface of the inner housing 20, the outer surface of the inner housing 20 preferably includes a plurality of discontinuities, such as the fin-like members 126, protruding into the refrigerant chamber 122.

The fin-like members 126 on the inner housing 20 can be formed in many different configurations, including but not limited to a generally axially-extending configuration, as shown for example in FIGS. 1, 3, and 5 through 8, or in the spirally-extending configuration of the fin-like members 126' on the alternate inner housing 20' shown for example in FIG. 9. The spirally-extending configuration shown in FIG. 9 can advantageously be used in applications where possible fatigue of the fin-like members is to be avoided or minimized. In either case, the fin-like members 126 (or 126') are circumferentially-spaced with respect to one another about substantially the entire outer surface of the inner housing 20. Furthermore, the radial dimension of the fin-like members 126 (or 126') should be sized to provide good heat transfer without unduly restricting the flow of the refrigerant material through the refrigerant chamber 122. In one experimental prototype of the combination evaporator and ice-forming assembly 12, such radial dimension of the fin-like members was sized to be approximately one-half of the radial space between the inner surface of the outer jacket member 120 and the outer ends of the fin-like members. It is not yet known whether or not this relationship is optimum, however, and other dimensional relationships may be determined by one skilled in the art to be more advantageous in a particular application and for a particular configuration of fin-like members. In addition to the provision of the fin-like members on the inner housing 20, the inner surface of the outer jacket member 120 can optionally be provided with dimples or ripples, or otherwise textured, in order to further enhance the turbulent flow of the refrigerant material through the annular refrigerant chamber 122.

The inlet end of the evaporator means 38 preferably includes a generally channel-shaped inlet member 128 surrounding the outer jacket member 120 in order to define a generally annular inlet manifold chamber 130 therebetween. A plurality of circumferentially-shaped inlet apertures 132 are provided through the outer jacket member 120 in order to provide fluid communication between the annular inlet manifold chamber 130 and the annular refrigerant chamber 122. Similarly, a generally channel-shaped outlet member 134 is provided at the opposite axial end of the evaporator means 38 and surrounds the outer jacket member 120 to define a generally annular outlet manifold chamber 136 therebetween. In order to provide communication between the outlet manifold chamber 136 and the refrigerant chamber 122, the outer jacket member 120 is provided with a plurality of circumferentially-spaced outlet apertures 138 generally at its axial end adjacent the channel-shaped outlet member 134. It should be noted that in addition to providing fluid communication between their respective inlet and outlet manifold chambers 130 and 136, the inlet and outlet apertures 132 and 138, respectively, also provide a manifolding function that enhances the turbulence of the refrigerant material flowing therethrough and facilitates an even distribution of refrigerant material throughout the circumference of the annular refrigerant chamber 122.

Preferably, the refrigerant inlet conduit 40 is connected in a tangential relationship with the channel-shaped inlet member 128 in order to direct the refrigerant material into the inlet manifold chamber 130 in a generally tangential direction, thereby enhancing the swirling or turbulent mixing and distribution of the refrigerant material throughout the inlet manifold chamber 130 and into the annular refrigerant chamber 122, as illustrated schematically by the flow arrows shown in FIG. 5. The refrigerant outlet conduit 42 can similarly be connected to the channel-shaped outlet member 134 in a tangential relationship therewith, or it can optionally be connected in a generally radially-extending configuration as shown in the drawings.

Figure 7:
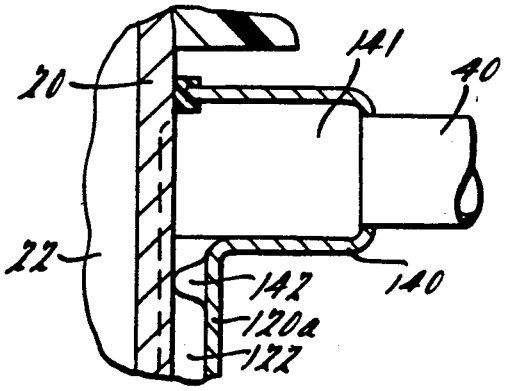
FIG. 7 is an enlarged cross-sectional view of an outlet manifold portion of an alternate embodiment of the combination evaporator and ice-forming assembly.

FIG. 7 illustrates an alternate embodiment of the evaporator means of the present invention, wherein the outer jacket member **120*a* includes a generally channel-shaped inlet portion 140 integrally formed therein. The integral channel-shaped inlet portion 140 surrounds the inner housing 20 and thus defines an annular inlet manifold chamber 141 therebetween. A series of circumferentially-spaced protuberances 142 are integrally formed about the circumference of the outer jacket member 120*a*. The protuberances 142 protrude into contact with the outer surface of the inner housing 20 in order to maintain a radially spaced relationship between the inner housing 20 and the outer jacket member 120*a* thus defining the annular refrigerant chamber 122 therebetween. The circumferential spaces between adjacent protuberances 142 provide fluid communication between the annular inlet manifold chamber 141 and the refrigerant chamber 122. It should be noted that in the alternate embodiment shown in FIG. 7, an annular outlet manifold chamber can also be formed by an integral channel-shaped outlet portion similar to the integrally-formed inlet portion 140**.

Figure 8:
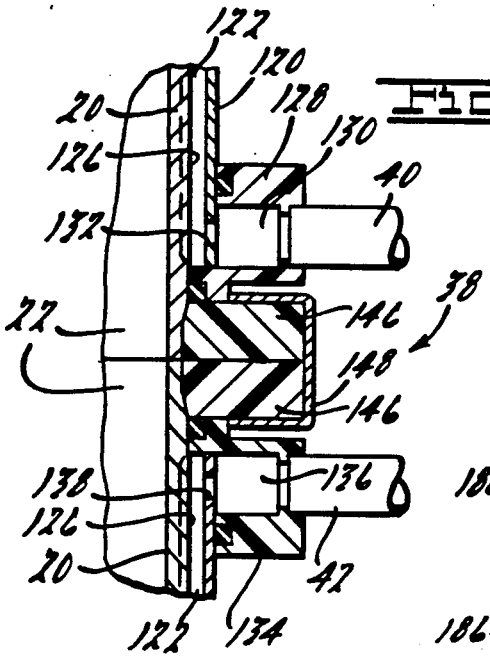
FIG. 8 is an enlarged cross-sectional view illustrating the interconnection of a pair of axially-stacked combination evaporator and ice-forming assemblies according to one embodiment of the present invention.

In either of the above-described embodiments, the inner housing 20 can optionally include a flange portion 146 extending radially from each of its opposite axial ends so that a number of the inner housings 20 may be sealingly stacked and interconnected to one another in a generally continuous axially-extending series as shown in FIG. 8. In such an arrangement, the freezing chamber 22 of the inner housing members 20 are in communication with one another with the flange portions 146 in a mutually abutting relationship and secured together such as by a clamping member 148, as shown in FIG. 8, or alternatively by other suitable clamping means. In such an arrangement, the inner housing members 20 are oriented such that the water inlet end of the inner housing 20 at one end of the series constitutes the water inlet for the entire series. Similarly, the ice outlet end of the inner housing member 20 at the opposite axial end of the series constitutes the ice outlet end of the evaporator series. Each of the axially-stacked inner housing members 20 has an outer jacket member and inlet and outlet manifold chambers, such as those described above, so that virtually any number of such evaporator assemblies may be axially stacked together to achieve a predetermined desired capacity for the ice-making apparatus.

As is the case for the various components of the first and second interchangeable head assemblies discussed above in connection with FIGS. 1 through 12, and below in connection with FIGS. 13 through 23, various component parts of the evaporator and ice-forming means may also be molded from a suitable synthetic plastic material, such as the above-discussed Delrin brand acetal thermoplastic resin for example. Other suitable non-plastic materials may, of course, also be used.

FIG. 1 also illustrates one preferred auger assembly 26, according to the present invention, which generally includes a central body portion 28 with at least one flight portion 30 extending generally in a spiral path along substantially the entire axial length of the auger assembly 26. In one preferred form of the invention, the spiral flight portion 30 is formed by a number of discontinuous flight segments 162 disposed in a generally end-to-end relationship with one another with each segment extending in a generally spiral direction along part of the spiral path of the flight portion 30. Adjacent end-to-end pairs of the discontinuous flight segments 162 are spirally misaligned relative to one another in order to form a spiral non-uniformity 164 between each pair. The spiral misalignments or non-uniformities 164 tend to break up the mass of ice particles scraped from the interior of the freezing chamber 22 as the auger 26 is rotated. It has been found that the breaking up of such ice particles as they are scraped from the freezing chamber 22 significantly reduces the amount of power necessary to rotatably drive the auger assembly. It should be noted that although only one spiral flight portion 30 is required in most applications, a number of separate spiral flight portions 30 axially spaced from one another and extending along separate spiral paths on the periphery of the central body portion 28 may be desirable in a given ice-making apparatus.

Preferably, the central body portion 28 and the spiral flight portion 30 of the auger assembly 26 are made up of a plurality of discrete disc elements 170 axially stacked on one another and keyed to, or otherwise secured for rotation with, the shaft member 71. The spiral non-uniformities 164 are preferably located at the interface between axially adjacent pairs of the disc elements 170. This preferred construction of the auger assembly 26 allows the discrete disc elements 170 to be individually molded from a synthetic plastic material, which significantly decreases the cost and complexity involved in manufacturing the auger assembly 26. Furthermore, such a construction provides a wide range of flexibility in the design and production of the auger assembly 26, including the flexibility of providing different slopes of the spirally-extending flight segments 162 from disc-to-disc, molding or otherwise forming different disc elements in the auger assembly 26 from different materials, such as plastics, cast brass, sintered metals, for example, and color-coding one or more of the disc elements 170 in order to aid in the assembly of the disc elements 170 on the shaft member 71 in the proper sequence. Another example of the flexibility provided by the preferred multiple-disc construction of the auger assembly 26 is the capability of providing specially-shaped flight segments or harder materials on the inlet and outlet end disc elements. Another additional advantage of the preferred auger assembly 26 is that in the event that a part of the spiral flight portion 39 is damaged somehow, only the affected disc elements 170 need to be replaced rather than replacing the entire auger assembly.

By providing such a multiple-disc construction for the auger assembly 26, the individual flight segments 162 on each disc element 170 can separately flex in an axial direction as the auger assembly 26 forcibly urges the scraped ice particles in an axial direction within the freezing chamber. Such axial flexibility greatly aids in the reduction or dampening of axial shock loads on the auger assembly 26 and thereby increases bearing life.

Figure 10:
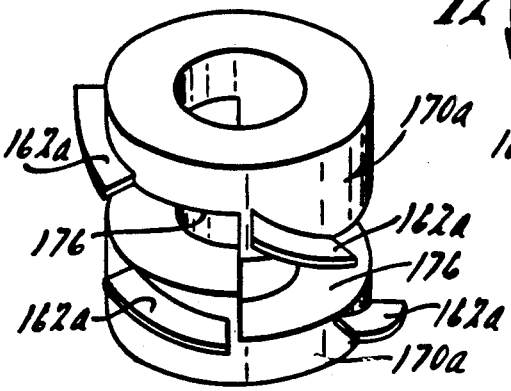
FIG. 10 is a perspective detail of an alternate embodiment of the disc element making up the auger assembly in one embodiment of the present invention.

FIG. 10 illustrates an alternate embodiment of the disc elements for the auger assembly 26, wherein the central body portion 28 and the spiral flight portion 30 are made up of alternate disc elements **170*a*, which are provided with offset mating faces 176. Such offset faces 176 can be employed to rotationally interlock the disc elements 170*a* with respect to one another in addition to the above-mentioned keying or otherwise securing of the disc elements 170 to the shaft member 71. Additionally, the shape or size of the stepped portions of the offset faces 176 can be varied from disc-to-disc in order to substantially prevent assembly of the disc elements on the shaft member 71** in an improper axial sequence.

Figure 11:
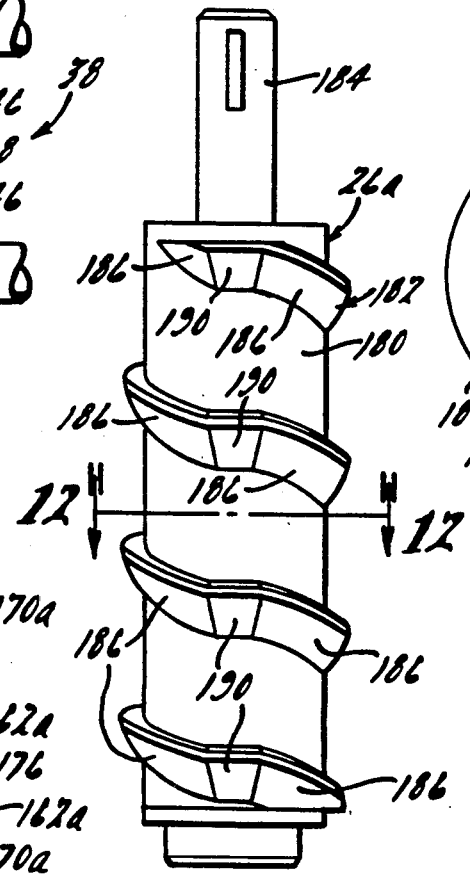
FIG. 11 is an elevational view of a one-piece auger assembly according to another embodiment of the present invention.
Figure 12:
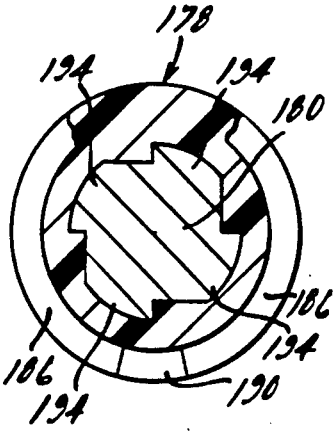
FIG. 12 is a cross sectional view taken generally along line 12—12 of FIG. 11.

FIGS. 11 and 12 illustrate still another alternate embodiment of the present invention wherein an alternate auger assembly **26*a* includes a central body portion 180 and a spiral flight portion 182, both of which are integrally molded as a one-piece structure onto a rotatable core member 184. The spiral flight portion 182 is made up of a plurality of discontinuous flight segments 186 that are spirally misaligned relative to one another as described above in connection with the preferred auger assembly 26**.

In order to facilitate the parting of the mold assembly used to integrally mold the central body portion 180 and the spiral flight portion 182 onto the rotatable core member 184, the discontinuous spiral flight segments 186 are preferably interconnected by generally flat interconnecting flight segments 190, which also form the spiral misalignments or non-uniformities between end-to-end adjacent flight segments 186. Each of the interconnecting flight segments 190 extends generally transverse to its associated discontinuous flight segments 186 and are preferably disposed generally perpendicular to the axis of rotation of the auger. Furthermore, in order to facilitate the parting of the mold apparatus used to form the alternate auger assembly **26*a*, the interconnecting flight segments 190 are preferably circumferentially aligned with one another along each of at least a pair of generally axially-extending loci on diametrically opposite sides of the central body portion 180, as shown in FIG. 11. It should also be noted that split interconnecting flight segments similar to the one-piece interconnecting flight segments 190 in the alternate auger assembly 26 may also be optionally provided on the preferred auger assembly 26 having discrete disc elements 170 axially stacked on the shaft member 71**, as described above.

As with various other components of the present invention described above, the disc elements 170 (or **170*a*) of the auger assembly 26 and the one-piece central body portion 180 and flight portion 182 of the auger assembly 26*a*** can be molded from a synthetic plastic material, such as Delrin brand acetal thermoplastic resin for example. Of course other suitable plastic or non-plastic materials can alternatively be employed.

In any of the alternate embodiments of the auger assembly shown and described herein, either a single spiral flight portion or a number of separate spiral flight portions may be provided. Also, instead of integrally molding the discontinuous flight segments onto the central bodies of either the preferred auger assembly 26 or the alternate auger assembly **26*a*, discontinuous discrete flight segments composed of various metals, plastics, or other dissimilar materials may be integrally molded into either the discrete disc elements 170 or into the one piece central body 180, respectively. Axially adjacent pairs of such discrete flight segments can also be circumferentially spaced relative to one another, as discussed below. Finally, in order to minimize the radial side loads on the bearings for either the shaft member 71 or the rotatable core member 184**, the leading or scraping surfaces (shown as upper surfaces in the drawings) of the flight portions in any of the embodiments of the auger assembly preferably protrude radially outwardly from the central body in a direction substantially perpendicular to the axis of rotation of the auger assembly. Thus, by substantially eliminating or minimizing the axial slope of such leading or scraping surfaces, the rotation of the auger assembly forcibly urges the scraped ice particles primarily in an axial direction, with relatively little radial force component, thereby minimizing radial side loads on the bearings.

In FIGS. 13 through 23, still additional alternate preferred embodiments of the present invention are illustrated, with the elements in FIGS. 13 through 23 being identified by reference numerals that are 200 numerals higher than the elements in FIGS. 1 through 12 that are generally similar in structure or function, or which correspond to, the identified elements in FIGS. 13 through 23.

Figure 13:
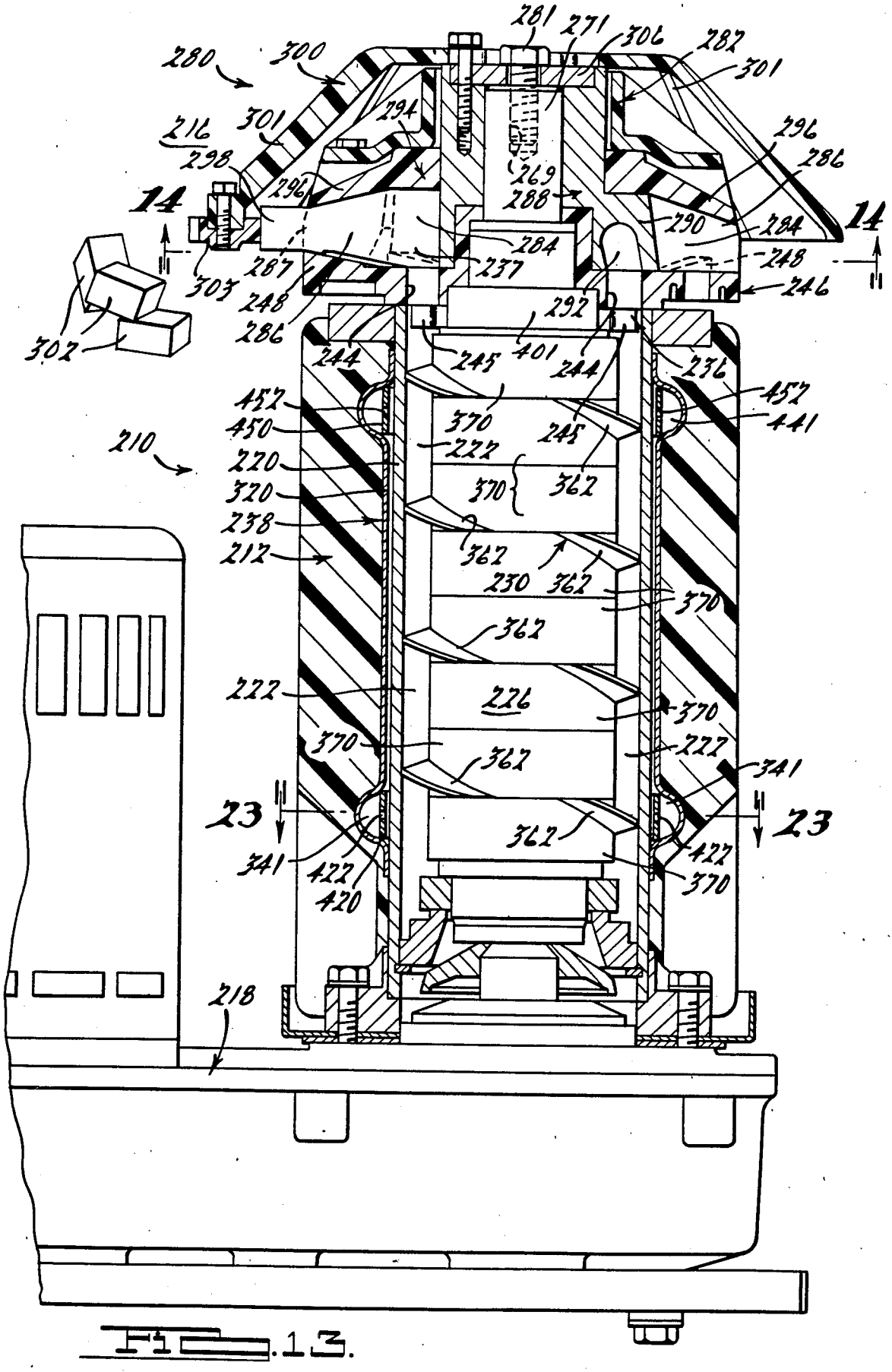
FIG. 13 is a partial cross-sectional view similar to FIGS. 1 and 3, but illustrating an alternate preferred embodiment of the combination evaporator and ice-forming assembly of an ice-making apparatus according to the present invention.
Figure 14:
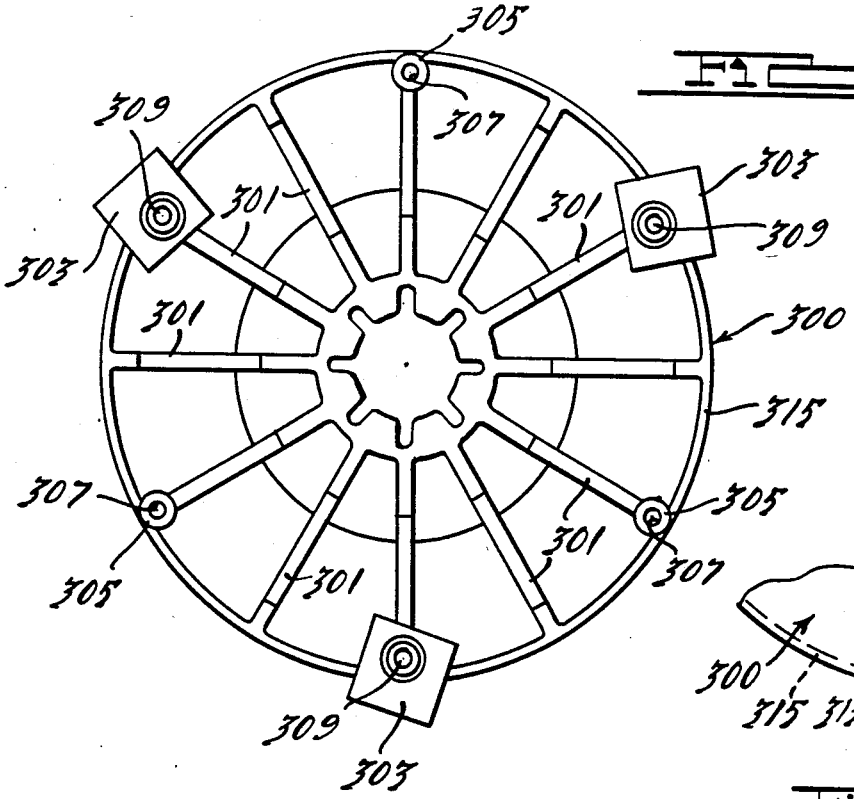
FIG. 14 is a bottom view of one preferred ice breaker apparatus of the combination evaporator and ice-forming assembly shown in FIG. 13, taken generally along line 14—14 thereof.
Figure 15:
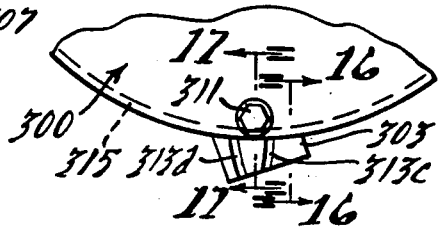
FIG. 15 is a detailed top view of a portion of the ice breaker apparatus of FIG. 14, illustrating one of the adjustable ice breaking elements thereon.
Figure 16:
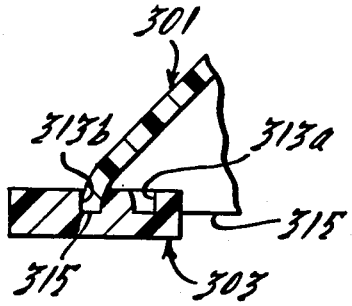
FIG. 16 is a cross-sectional view through the adjustable ice breaking element of FIG. 15, taken generally along line 16—16 thereof.
Figure 17:
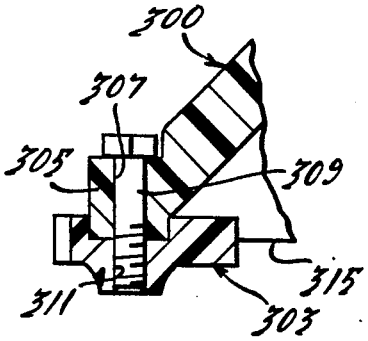
FIG. 17 is a cross-sectional view through the adjustable ice breaking element of FIG. 15, taken generally along line 17—17 thereof.
Figure 17A:
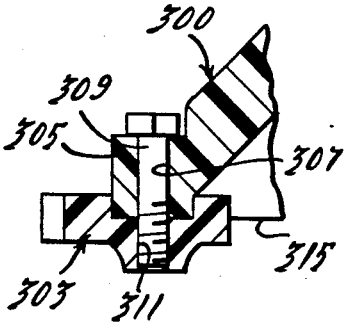
FIGS. 17A through 17C are cross-sectional views similar to FIG. 17, but illustrating the adjustable ice breaking element rotated to various adjusted positions with corresponding radial protrusions of the ice breaker element relative to the remainder of the breaker apparatus.
Figure 17B:
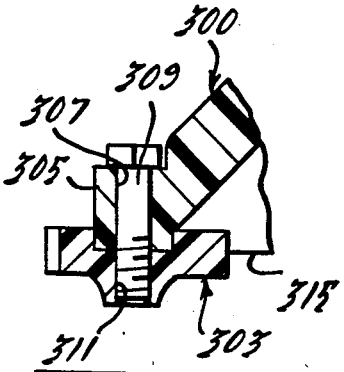
Figure 17C:
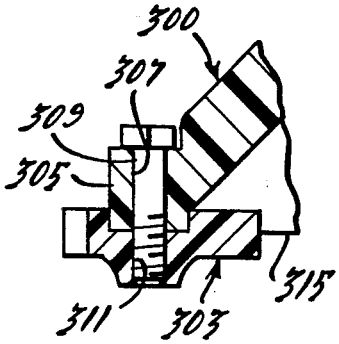
Figure 18:
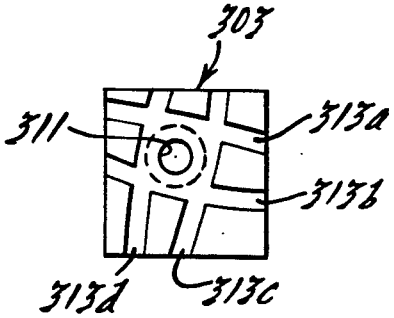
FIG. 18 is a top view of the preferred adjustable ice breaking element of FIG. 14.
Figure 19:
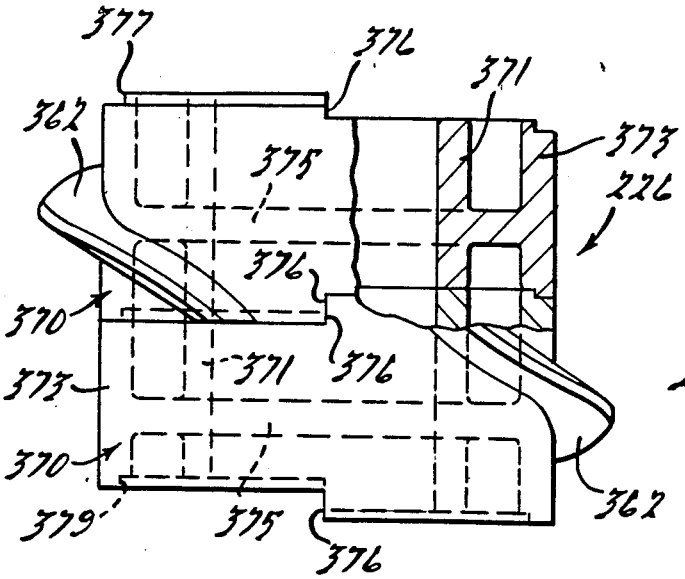
FIG. 19 is an enlarged view, partially in cross-section, of still another alternate embodiment of the disc elements making up the auger assembly in one embodiment of the present invention.

FIG. 13 illustrates a second interchangeable head assembly 280, which is generally similar to the second interchangeable head assembly 80 discussed above except that the ice breaker apparatus 300 shown in FIG. 13 includes one or more adjustable ice breaker members or tabs 303 removably and adjustably secured thereto. In contrast to the ice breaker 100 described above, wherein the internal ribs 101 contacted and broke the elongated compacted ice form 98 into discrete compacted ice cubes as the shaft member and the ice breaker rotated, the ice breaker members 303 contact and forcibly break off the elongated compacted ice forms 298 to discrete compacted ice cubes 302 as the ice breaker apparatus 300 is rotated by the shaft 271.

As is more fully illustrated in FIGS. 14 through 18, the ice breaker apparatus 300, which is now preferred, includes a number of bosses 305 circumferentially spaced about its outer periphery, each of such bosses 305 having an aperture 307 extending axially therethrough. The bosses 305 and their apertures 307 are spaced at predetermined locations about the periphery of the ice breaker apparatus 300 such that one or more of the ice breaker members or tabs 303 may be removably secured thereto by way of threaded fasteners 309 (or other fasteners, such as quick-release fasteners) extending through the apertures 307 into corresponding apertures 311 in the ice breaker members 303. Preferably, the ice breaker apparatus 300 includes internal strengthening ribs 301 thereon, with the circumferential locations of the bosses 305 coinciding with the circumferential positions of at least some of the internal ribs 301, thereby providing added strength and stiffness to the overall ice breaker/ice breaker tab assembly.

As is further illustrated in FIGS. 14 through 18, the preferred ice breaker members or tabs 303 include a number of locating grooves or slots, such as locating slots 313*a* through 313*d*, formed therein. The locating slots 313*a* through 313*d* are arcuate in configuration and match the curvature of the outer peripheral edge 315 of the ice breaker apparatus 300. Thus, by preselectively and removably attaching the ice breaker tabs 303 to the ice breaker 300 with the ice breaker peripheral edge 315 being received in the various locating slots 313*a* through 313*d*, the extent of protrusion of the ice breaker members 303 radially inwardly toward the outer openings 287 of the compacting passages 286 (see FIG. 13) is correspondingly altered, and thereby the outward protrusion of the elongated compacted ice form 298 is altered before it is engaged and forcibly broken into a discrete compacted ice cube 302 of a corresponding size as the ice breaker 300 is rotated.

Although the ice breaker members 303 shown in the drawings include four locating slots 313*a* through 313*d* formed therein, one skilled in the art will readily recognize that either lesser or greater numbers of locating slots can be formed in a given ice breaker member in accordance with the present invention, in order to obtain a corresponding number of adjustable positions of such ice breaker member. Furthermore, although six of the above-discussed bosses 305 and corresponding apertures 307 are shown on the rotatable ice breaker apparatus 300 illustrated in the drawings, so that one, two, three, or even six, equally-spaced ice breaker members 303 can be removably attached thereto, one skilled in the art will now also readily recognize that virtually any number of such bosses 305 and ice breaker members 303 may be included, depending upon the speed of rotation of the ice breaker apparatus 300 and the desired size of the discrete compacted ice cubes 302 to be broken off thereby.

FIG. 13 also illustrates another auger assembly 226 according to the present invention, which is now preferred over the other embodiments discussed above and illustrated in FIGS. 1 through 12. As with the previously-discussed embodiments, however, a number of discrete disc elements 370 are axially stacked on one another and keyed to, or otherwise secured for rotation with, the shaft member 271, and the flight segments 362 on the disc elements 370 are preferably spirally discontinuous relative to one another at least on axially-adjacent disc elements 370. Furthermore, in the auger assembly 226, it is preferred that the flight segments 362 on axially-adjacent disc elements 370 not only be spirally discontinuous relative to one another, but also that their axially-adjacent ends be circumferentially spaced relative to one another in order to provide a circumferentially-extending gap therebetween. Such circumferential gap, as well as the fact that the adjacent flight segments 362 lie on different spiral paths, contributes to the breaking up of the mass of ice particles scraped from the interior of the freezing chamber 222 as the auger assembly 226 is rotated. As is noted above, it has been found that the breaking up of such masses of ice particles as they are scraped from the freezing chamber 222 significantly reduces the amount of power necessary to rotatably drive the auger assembly.

Like the alternate disc elements 170*a*, illustrated in FIG. 10 and discussed above, the disc elements 370 in the now-preferred auger assembly 226 are also equipped with stepped or offset mating faces 376 that serve to rotationally interlock the axially-adjacent disc elements 370 with respect to one another. Furthermore, the disc elements 370 are also preferably configured such that axially-adjacent disc elements 370 axially nest with one another by way of the reduced diameter, or stepped, portion 377 of each disc 370 being nestably received within the relieved or recessed internal portion 379 on its axially-adjacent disc 370. Such rotational interlocking, and axially nesting, features of the disc elements 370 and the preferred auger assembly 226, tend to result in a more unitized and solid auger assembly that approaches the rotational and axial strength of a one-piece auger assembly, while still maintaining the appropriate resiliency, flexibility and ease of partial replacement advantages of a multi-piece construction.

In addition to the above features and advantages of the preferred auger assembly 226, the disc elements 370 are also formed of a synthetic plastic material capable of withstanding the forces, low temperatures and other parameters encountered by such components in an ice-making apparatus, one example of such a material being Delrin brand acetal thermoplastic resin, which is discussed above. Because the disc elements 370 are composed of such a material, they can be injection molded or otherwise moldably formed in a variety of advantageous configurations. One preferred example of such advantageous configurations is that shown in FIG. 19, wherein each of the disc elements 370 includes a generally cylindrical inner wall 371 and a generally cylindrical outer wall 373 radially spaced from the inner wall 371, with such inner and outer walls 371 and 373, respectively, being interconnected and reinforced by a radially-extending reinforcing portion 375. By such a construction, the radial and axial strength of each of the disc elements 370 are preserved, while maintaining an air space extending axially along a substantial portion of the axial length of the disc elements 370. Such air space provides thermal insulation between the shaft 271 and the freezing chamber 222 of the combination evaporator and auger assembly, as well as contributing to the overall reduction in weight of the auger assembly 226.

Figure 20:
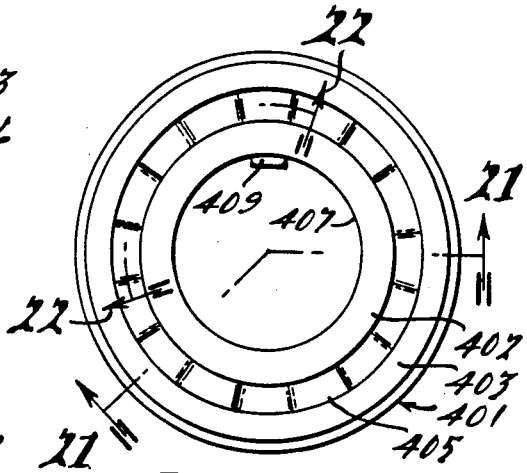
FIG. 20 is a top view of the auger bearing of FIG. 13, according to one embodiment of the present invention.
Figure 21:
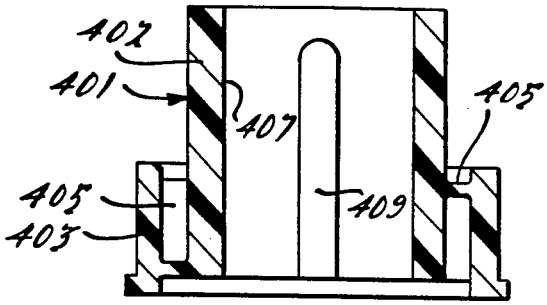
FIG. 21 is a cross-sectional view of the auger bearing of FIG. 20, taken generally along line 21—21 thereof.
Figure 22:
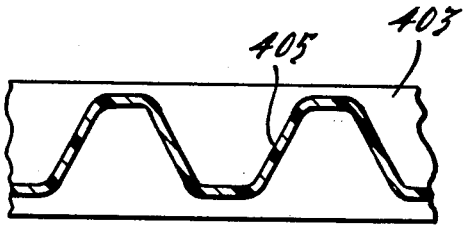
FIG. 22 is another cross-sectional view of the auger bearing of FIG. 20, taken generally along line 22—22 thereof.

As is further shown in FIG. 13, the combination evaporator and ice-forming assembly 212 also preferably includes a friction-reducing auger bearing 401 interposed between the auger assembly 226 and the fixed divider plate 246. The auger bearing 401 is preferably composed of a nylon or nylon-containing material, which has been found to provide a low-friction interface with, and to reduce wear of, the divider plate 246, which is preferably composed of an acetal thermoplastic resin or other such material containing acetal thermoplastic resin. As is shown in FIGS. 13, and 20 through 22, the auger bearing 401 is generally of a stepped-like configuration such that it is interposed both radially and axially between the auger assembly 226 (or its disc elements 370) and the divider plate 246. Preferably, the bearing 401 is of a light-weight construction and configuration as illustrated in FIGS. 20 through 21, wherein an interior cylindrial wall 402 is surrounded by and spaced from an axially shorter exterior cylindrical wall 403, with the walls being interconnected by an axially-undulating reinforcing portion 405. The exterior outer cylindrical wall 403 and the reinforcing portion 405 provide the axial and radial strength necessary to withstand the forces encountered during operation of the auger assembly 226, while still maintaining a light-weight, low-friction bearing of a generally stepped configuration that therefore serves as a rotational bearing as well as an axial thrust bearing. As is shown in the drawings, the internal bore 407 preferably includes a key portion 409 for rotationally interlocking the bearing 401 to the shaft 271.

Figure 23:
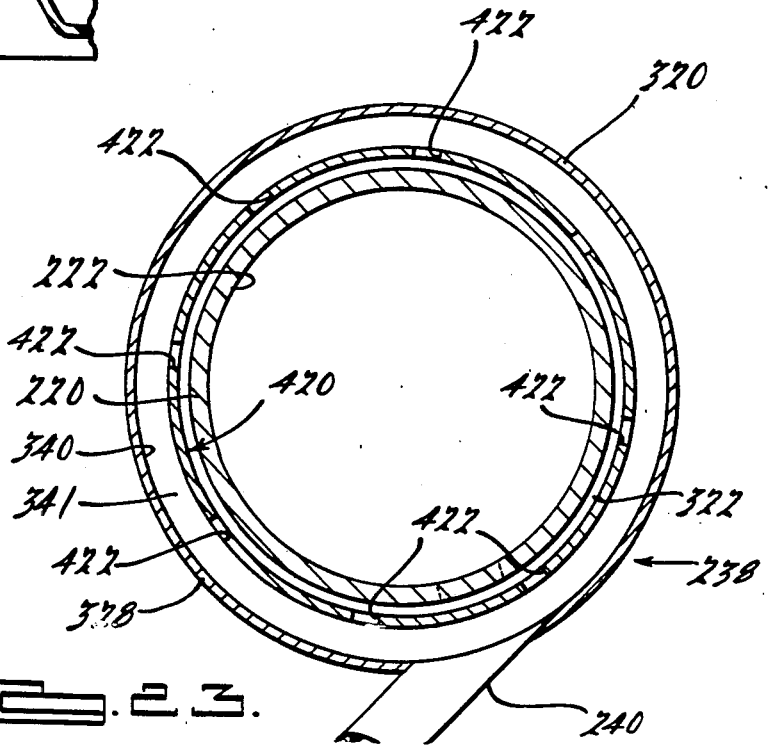

FIG. 23 illustrates still another alternate embodiment (now preferred) of the evaporator means of the present invention, wherein the outer jacket member 320 includes a radially-enlarged and generally channel-shaped annular inlet portion 340 integrally formed therein. The integral channel-shaped annular inlet portion 340 surrounds the inner housing 220 and thus defines an annular inlet manifold chamber 341 therebetween. The evaporator assembly 238 differs significantly, however, from the embodiments discussed above in that an inlet distributor member 420 extends generally circumferentially through all, or at least a substantial portion of, the annular inlet manifold chamber 341, between the inner housing 220 and the outer jacket member 320.

The inlet distributor member includes a plurality of circumferentially-spaced inlet apertures 422 extending therethrough along a substantial portion of the inlet distributor member 420. The inlet apertures 422 provide fluid communication between the annular inlet manifold chamber 341 and the refrigerant chamber 322, as well as providing a relatively uniform circumferential distribution of refrigerant therearound. In addition to the relatively uniform distribution function of the distributor member 420, the apertures 422 also induce an advantageous turbulence into the flow of the refrigerant into the evaporator assembly 238, thereby further facilitating a relatively even heat transfer to the refrigerant material throughout the circumference of the annular refrigerant chamber 322.

Although only the inlet portion of the evaporator assembly 238 is illustrated in FIG. 23, one skilled in the art will now readily recognize that a correspondingly similar configuration and function is employed and obtained in the annular outlet manifold chamber 441, with its outlet distributor member 450 and the outlet apertures 452 extending therethrough as shown in FIG. 13. Both the inlet distributor 420 and the outlet distributor 450 can preferably be fabricated by forming their respective inlet and outlet apertures 422 and 452 in a flat elongated strip of metal, plastic, or other suitable material. Once the apertures are formed therein, the elongated flat material is then rolled or otherwise formed into a generally circular configuration around the inner housing 220. Finally, it should also be noted that the above-discussed spirally-extending fin-like members 126 or 126', or other surface discontinuities or textured configurations, can also optionally be used in connection with the evaporator assembly 238.

The foregoing discussion discloses and describes exemplary embodiments of the present invention. One skilled in the art will readily recognize from such discussion that various changes, modifications and variations may be made therein without departing from the spirit and scope of the invention as defined in the following claims.

What is claimed is:

1. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger includes a central body portion, at least one flight portion extending in a generally spiral path along at least a substantial part of the axial length of the periphery of said central body portion with the outer edges of said flight portion being adapted to be disposed closely adjacent the inner surface of the housing in order to scrape ice particles therefrom as said auger is rotated, said flight portion being defined by at least a pair of axially adjacent discontinuous flight segments generally circumferentially spaced from one another and extending in a generally spiral direction along a part of said generally spiral path, said adjacent pair of said discontinuous flight segments being spirally misaligned relative to one another in order to form a spiral non-uniformity therebetween, said spiral misalignment and said circumferential spacing of said adjacent discontinuous flight segments tending to break up the mass of ice particles scraped from the inner surface of the housing as said auger is rotated, said adjacent pair of discontinuous flight segments being interconnected by an interconnecting flight segment, said interconnecting flight segment extending in a direction generally transverse to said discontinuous flight segments.

2. The invention according to claim 1, wherein said auger comprises a plurality of discrete disc elements axially stacked on a rotatable shaft member and removably secured for rotation therewith, the axial length of each of said disc elements being substantially less than the axial length of said auger.

3. The invention according to claim 2, wherein said disc elements are individually molded from a synthetic plastic material.

4. The invention according to claim 2, wherein axially adjacent disc elements are axially nested and radially interlocked with one another.

5. The invention according to claim 1, wherein said central body portion and said flight portion are integrally molded as a one-piece structure onto a rotatable core member.

6. The invention according to claim 5, wherein said one-piece central body portion and flight portion are molded from a synthetic plastic material.

7. The invention according to claim 2, wherein said misalignment between adjacent pairs of said discontinuous flight segments is located at the interface between axially adjacent pairs of said disc elements.

8. The invention according to claim 2, wherein at least one of said disc elements is formed from a material different from that of the other disc elements.

9. The invention according to claim 1, wherein said interconnecting flight segments are generally flat and extend along said periphery of said auger in a direction generally perpendicular to the axis of rotation of said auger.

10. The invention according to claim 9, wherein said interconnecting flight segments are generally circumferentially aligned with one another along each of at least a pair of generally axially-extending loci on generally diametrically opposite sides of said auger.

11. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger includes a central body portion, at least one flight portion extending in a generally spiral path along at least a substantial part of the axial length of the periphery of said central body portion with the outer edges of said flight portion being adapted to be disposed closely adjacent the inner surface of the housing in order to scrape ice particles therefrom as said auger is rotated, said flight portion being defined by at least a pair of axially adjacent discontinuous flight segments generally circumferentially spaced from one anotherand extending in a generally spiral direction along a part of said generally spiral path, said adjacent pair of said discontinuous flight segments being spirally misaligned relative to one another in order to form a spiral non-uniformity therebetween, said spiral misalignment and said circumferential spacing of said adjacent discontinuous flight segments tending to break up the mass of ice particles scraped from the inner surface of the housing as said auger is rotated, said auger including a plurality of discrete disc elements axially stacked on a rotatable shaft member and removably secured for rotation therewith, the axial length of each of said disc elements being substantially less than the axial length of said auger, each of said disc elements including a generally cylindrical inner wall and a generally cylindrical outer wall radially spaced therefrom, said flight portion protruding radially outwardly from said outer wall on at least one of said disc elements, said inner and outer walls being interconnected by a radial reinforcing member.

12. The invention according to claim 11, wherein said disc elements are individually molded from a synthetic plastic material.

13. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger comprises a rotatable shaft member, a plurality of discrete disc elements axially stacked on said shaft member and secured for rotation therewith, the axial length of each of said disc elements being substantially less than the axial length of said auger, said discrete disc elements defining a central body portion and at least one flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said flight portion being defined by a plurality of discontinuous flight segments disposed generally end-to-end adjacent one another along said generally spiral path, adjacent pairs of said discontinuous flight segments being spirally misaligned relative to one another in order to form spiral non-uniformities therebetween, said spiral misalignment of said adjacent discontinuous flight segments tending to break up the mass of ice particles scraped from the inner surface of the housing as said auger is rotated, at least one of said disc elements being formed from a material different from that of at least some of the other disc elements.

14. The invention according to claim 13, wherein said misalignment between adjacent pairs of said discontinuous flight segments is located at the interface between axially adjacent pairs of said disc elements.

15. The invention according to claim 13, wherein said disc elements are individually molded from a synthetic plastic material.

16. The invention according to claim 13, wherein said discrete disc elements define a number of said flight portions axially spaced from one another and extending along separate generally spiral paths on said periphery of said central body portion.

17. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger comprises a rotatable shaft member, a plurality of discrete disc elements axially stacked on said shaft member and secured for rotation therewith, the axial length of each of said disc elements being substantially less than the axial length of said auger, said discrete disc elements defining a central body portion and at least one flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said flight portion being defined by a plurality of discontinuous flight segments disposed generally end-to-end adjacent one another along said generally spiral path, adjacent pairs of said discontinuous flight segments being spirally misaligned relative to one another in order to form spiral non-uniformities therebetween, said spiral misalignment of said adjacent discontinuous flight segments tending to break up the mass of ice particles scraped from the inner surface of the housing as said auger is rotated, said freezing chamber including an outlet end through which said ice particles are discharged therefrom, one of said disc elements being located generally at said outlet end and being composed of a harder material than at least some of the other disc elements.

18. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger comprises a rotatable shaft member, a plurality of discrete disc elements axially stacked on said shaft member and secured for rotation therewith, the axial length of each of said disc elements being substantially less than the axis length of said auger, said discrete disc elements defining a central body portion and at least one flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said flight portion being defined by a plurality of discontinuous flight segments disposed generally end-to-end adjacent one another along said generally spiral path, adjacent pairs of said discontinuous flight segments being spirally misaligned relative to one another in order to form spiral non-uniformities therebetween, said spiral misalignment of said adjacent discontinuous flight segments tending to break up the mass of ice particles scraped from the inner surface of the housing as said auger is rotated, the central body portion of each of said disc elements being molded from a synthetic plastic material, said flight portion of each of said disc elements being a discrete structure integrally molded into said synthetic plastic material.

19. The invention according to claim 18, wherein the spiral slope of at least some of said flight segments vary from segment-to-segment.

20. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger comprises a rotatable shaft member, a plurality of discrete disc elements axially stacked on said shaft member and secured for rotation therewith, the axial length of each of said disc elements being substantially less than the axial length of said auger, said discrete disc elements defining a central body portion and at least one flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said flight portion being defined by a plurality of discontinuous flight segments disposed generally end-to-end adjacent one another along said generally spiral path, adjacent pairs of said discontinuous flight segments being spirally misaligned relative to one another in order to form spiral non-uniformities therebetween, said spiral misalignment of said adjacent discontinuous flight segments tending to break up the mass of ice particles scraped from the inner surface of the housing as said auger is rotated, each of said adjacent pairs of said discontinuous flight segments along said generally spiral path are interconnected by an interconnecting flight segment therebetween, each of said interconnecting flight segments extending in a direction generally transverse to its associated discontinuous flight segments.

21. The invention according to claim 20, wherein said interconnecting flight segments are generally flat and extend along said periphery of said central body portion in a direction generally perpendicular to the axis of rotation of said auger.

22. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger includes a rotatable core member, a central body portion, a flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said central body portion and said flight portion being integrally molded as a one-piece structure onto said rotatable core member, said flight portion being defined by a plurality of discontinuous flight segments disposed generally end-to-end adjacent one another along said generally spiral path, adjacent pairs of said discontinuous flight segments being interconnected end-to-end but spirally misaligned relative to one another in order to form spiral non-uniformities therebetween, said spiral misalignment of said adjacent discontinuous flight segments tending to break up the mass of ice particles scraped from the inner surface of the housing as said auger is rotated, each of said adjacent pairs of said discontinuous flight segments along said generally spiral path being interconnected by an interconnecting flight segment therebetween, each of said interconnecting flight segments extending in a direction generally transverse to its associated discontinuous flight segments.

23. The invention according to claim 22, wherein said interconnecting flight segments are generally flat and extend along said periphery of said central body portion in a direction generally perpendicular to the axis of rotation of said auger.

24. The invention according to claim 23, wherein said interconnecting flight segments are generally circumferentially aligned with one another along each of at least a pair of generally axially-extending loci on diametrically opposite sides of said central body.

25. The invention according to claim 22, wherein said one-piece central body portion and flight portion are molded from a synthetic plastic material.

26. The invention according to claim 22, wherein said auger includes a number of said flight portions axially spaced from one another and extending along separate generally spiral paths on said periphery of said central body portion.

27. The invention according to claim 26, wherein said one-piece central body portion and flight portion are molded from a synthetic plastic material.

28. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger includes a rotatable core member, a central body portion, a flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said central body portion being integrally molded onto said rotatable core member from a synthetic plastic material, said flight portion being a discrete structure integrally molded into said plastic material, said flight portion being defined by a plurality of discontinuous flight segments disposed generally end-to-end adjacent one another along said generally spiral path, adjacent pairs of said discontinuous flight segments being interconnected end-to-end but spirally misaligned relative to one another in order to form spiral non-uniformities therebetween, said spiral misalignment of said adjacent discontinuous flight segments tending to break up the mass of ice particles scraped from the inner surface of the housing as said auger is rotated.

29. In an ice-making apparatus including a housing defining a substantially cylindrical freezing chamber, refrigeration means adjacent the freezing chamber, means for supplying ice make-up water to the freezing chamber, an axially-extending auger rotatably mounted in the freezing chamber, the improvement wherein said auger includes a rotatable core member, a central body portion, a flight portion extending in a generally spiral path along at least a substantial part of the periphery of said central body portion with an outer edge of said flight portion being adapted to be disposed closely adjacent the inner surface of the housing in order to scrape ice particles therefrom as said auger is rotated, said central body portion being integrally molded onto said rotatable core member from a synthetic plastic material, said flight portion being a discrete structure integrally molded into said plastic material, said flight portion being defined by a plurality of discontinuous flight segments disposed generally end-to-end adjacent one another along said generally spiral path, adjacent pairs of said discontinuous flight segments being interconnected end-to-end but spirally misaligned relative to one another in order to form spiral non-uniformities therebetween, said spiral misalignment of said adjacent discontinuous flight segments tending to break up the mass of ice particles scraped from the inner surface of the housing of said auger is rotated, each of said adjacent pairs of said discontinuous flight segments along said generally spiral path being interconnected by an interconnecting flight segment therebetween, each of said interconnecting flight segments extending in a direction generally transverse to its associated discontinuous flight segments.

30. The invention according to claim 29, wherein said interconnecting flight segments are generally flat and extend along said periphery of said central body portion in a direction generally perpendicular to the axis of rotation of said auger.

31. The invention according to claim 30, wherein said interconnecting flight segments are generally circumferentially aligned with one another along each of at least a pair of generally axially-extending loci on diametrically opposite sides of said central body.

* * * * *

UNITED STATES PATENT AND TRADEMARK OFFICE

CERTIFICATE OF CORRECTION

PATENT NO. : 4,682,475

DATED : July 28, 1987

INVENTOR(S) : Kenneth L. Nelson

It is certified that error appears in the above-identified patent and that said Letters Patent is hereby corrected as shown below:

| | |
|---|---|
| Col. 3, Line 22, Page 5, Line 1 | "invention" should be —inventive— |
| Col. 3, line 62, Page 6, Line 3 | "macine" should be —machine— |
| Col. 4, Lines 10-11, Page 6, Line 14 | "ice-forming" should be —ice making— |
| Col. 4, Line 13, Page 6, Line 17 | "interchangable" should be —interchangeable— |
| Col. 4, Line 40, Page 7, Line 11 | after "detail" insert —view— |
| Col. 4, Line 41, Page 7, Line 12 | "element" should be —elements— |
| Col. 5, Line 29, Page 8, Line 26 | after "refrigeration" insert —apparatus— |
| Col. 5, Line 37, Page 9, Line 5 | *"condensor" should be —condenser— |
| Col. 5, Line 44, Page 9, Line 9 | *"condensor" should be —condenser— |
| Col. 5, Line 45, Page 9, Line 45 | *"condensor" should be —condenser— |
| Col. 5, Lines 65-66, Page 9, Line 26 | after "make-up" insert —water— |
| Col. 6, Line 9, Page 10, Line 6 | after "through" insert —which— |
| Col. 7, Line 2, Page 11, Line 24 | "resilent" should be —resilient— |

UNITED STATES PATENT AND TRADEMARK OFFICE

CERTIFICATE OF CORRECTION

PATENT NO. : 4,682,475

DATED : July 28, 1987

INVENTOR(S) : Kenneth L. Nelson

It is certified that error appears in the above-identified patent and that said Letters Patent is hereby corrected as shown below:

| | |
|---|---|
| Col. 7, Line 7, Page 11, Line 28 | after "chip" insert --ice-- |
| Col. 8, Line 65, Page 15, Line 8 | "numer" should be —number-- |
| Col. 13, Line 39, Page 23, Line 14 | "39" should be --30-- |
| Col. 19, Line 43, Claim 11, Pages 14-15, Claim 13, Amend. Dated: 11/26/86 | "anotherand" should be —another and-- |

Signed and Sealed this

Twenty-ninth Day of December, 1987

*Attest:*

*Attesting Officer*

DONALD J. QUIGG

*Commissioner of Patents and Trademarks*